US012799728B2

(12) United States Patent
Bai

(10) Patent No.: US 12,799,728 B2
(45) Date of Patent: Nov. 17, 2026

(54) CONNECTOR FOR CONNECTING SEAT BOWL AND BASE AND PORTABLE TOILET

(71) Applicant: QINGDAO CHUANGHUI TIMES TRADE SERVICE CO., LTD., Qingdao (CN)

(72) Inventor: Guifen Bai, Qingdao (CN)

(73) Assignee: QINGDAO CHUANGHUI TIMES TRADE SERVICE CO., LTD., Qingdao (CN)

( * ) Notice: Subject to any disclaimer, the term of this patent is extended or adjusted under 35 U.S.C. 154(b) by 169 days.

(21) Appl. No.: 18/824,582

(22) Filed: Sep. 4, 2024

(65) Prior Publication Data

US 2025/0389110 A1 Dec. 25, 2025

(30) Foreign Application Priority Data

Jun. 25, 2024 (CN) ..... 202421456506.9
Jul. 9, 2024 (CN) ..... 202421611628.0

(51) Int. Cl.
*E03D 11/17* (2006.01)
*A47K 13/00* (2006.01)

(52) U.S. Cl.
CPC ..... *E03D 11/17* (2013.01); *A47K 13/005* (2013.01)

(58) Field of Classification Search
CPC ..... E03D 11/14; E03D 11/16; E03D 11/17; A47K 13/005
USPC ..... 4/300, 251.1, 252.1–252.6
See application file for complete search history.

(56) References Cited

U.S. PATENT DOCUMENTS 2,673,985 A * 4/1954 Gay ..... E03D 11/16 4/252.1
4,872,222 A * 10/1989 Pavlik ..... E03D 9/038 4/227.4
2001/0023505 A1* 9/2001 Atkins ..... E03D 11/16 4/252.6
2007/0192951 A1* 8/2007 Durrani ..... E03D 11/16 4/420

FOREIGN PATENT DOCUMENTS

CN 103147499 A 6/2013
KR 100841718 B1 * 6/2008 ..... E03D 11/16

* cited by examiner

*Primary Examiner* — Tuan N Nguyen
(74) *Attorney, Agent, or Firm* — J.C. PATENTS

(57) ABSTRACT

The present application provides a connector for connecting a seat bowl and a base, and portable toilet; wherein, the connector includes: a first part, facing to and being connected with the seat bowl in a connected state; a second part, facing to and being connected with the base in the connected state; a sewage hole, formed in a middle part of the connector and penetrating through the first part and the second part; and an embedding part, protrudingly formed on the first part and capable of being matched with an embedding groove at a bottom of the seat bow.

18 Claims, 6 Drawing Sheets

CONNECTOR FOR CONNECTING SEAT BOWL AND BASE AND PORTABLE TOILET

The present application claims the priority benefits of Chinese application No. 202421456506.9, filed on Jun. 25, 2024, entitled "Connector for Connecting Seat Bowl and Base", and Chinese application No. 202421611628.0, filed on Jul. 9, 2024, entitled "Connector for Connecting Seat Bowl and Base and Portable Toilet", the entirety of which are hereby incorporated by reference.

TECHNICAL FIELD

The present application belongs to the field of sanitary ware, and in particular to a connector for connecting a seat bowl and a base, and a portable toilet.

BACKGROUND

At present, mobile portable water-flushing toilets are mainly mounted on recreational vehicles or other mobile tools, and there are mainly two types in structure, direct discharge type and storage type. At present, the commonly used portable water-flushing toilet is generally blow-molded by a blow molding process, and includes a seat bowl and a base. Some consumers still prefer the seat bowl made of ceramic material, but when the seat bowl made of ceramic material is matched with a plastic base, it is easy to cause the problem of poor alignment, resulting in the loosening of the seat bowl.

CN103147499A provides a water-flushing seat bowl and extensible portable toilet thereof; the water-flushing seat bowl comprises a seat bowl provided with an inner liner; an elastic ring, a clamping ring and a J-shaped sealing ring are sequentially arranged below a lower discharging pipe of the seat bowl, and then a nut is arranged, so that the seat bowl and the inner liner form end surface sealing; there is a cavity inside for containing clean water, a double-head water spraying nozzle is arranged; a pipeline is arranged in the cavity and is respectively communicated with a four-way valve, the water spraying nozzle and a hand-pressed air pump; and a button switch is arranged on one side to manually control the clear water in the seat bowl to flush.

SUMMARY

To overcome some of the shortcomings in the prior art, the present application provides a connector for connecting a seat bowl and a base (hereinafter referred to as connector for short) and a portable toilet.

A first aspect of the present application provides a connector for connecting a seat bowl and a base, including:

- a first part, facing to and being connected with the seat bowl in a connected state;
- a second part, facing to and being connected with the base in the connected state;
- a sewage hole, formed in a middle part of the connector and penetrating through the first part and the second part; and
- an embedding part, protrudingly formed on the first part and capable of being matched with an embedding groove at a bottom of the seat bowl.

An outer wall of the embedding part is provided with a plurality of fins at intervals, able to be squeezed to deform; and the connector is configured as: when the seat bowl is connected with the connector, the embedding part and the fins thereof are in interference fit in the embedding groove of the seat bowl.

In an example, the seat bowl is made of ceramic material; and the connector is made of plastic material, with a flat structure.

In an example, the fins are elastic plastic sheets, evenly distributed on the outer wall of the embedding part; and an extending direction of each fin is parallel to a connecting direction of the seat bowl and the connector.

In an example, a bottom of each fin is connected with the first part of the connector; and a chamfer is formed at one end of each fin toward the seat bowl, so as to guide the embedding part and the fins to be inserted into the embedding groove.

In an example, the connector is provided with a plurality of first mounting holes and second mounting holes around the sewage hole, respectively penetrating through the first part and the second part of the connector; the first mounting holes are configured to mount the connector onto the seat bowl; and the second mounting holes are configured to mount the connector onto the base.

In an example, the second part of the connector is provided with a buckle body, able to be clamped into a buckling groove of the base to connect the connector and the base.

In an example, the buckle body has an extension part able to be squeezed and deformed; a second protruding part is provided at a free end of the extension part, so as to be clamped into the buckling groove of the base; and one side of the second protruding part toward the base is an inclined surface to guide the clamping.

In an example, the second part of the connector is provided with a plurality of buckle bodies at intervals around the sewage hole; the buckle bodies are located on a circumference of a same circle, and are able be clamped into an annular buckling groove of the base, so as to be in a rotatable state.

In an example, the sewage hole is provided with a first groove at the first part to accommodate a first sealing ring, so that the seat bowl and the connector are able to be sealed; and the sewage hole extends from the second part toward the base and an annular step shape is formed at a free end of the sewage hole, and a second sealing ring is matched with the step shape of the sewage hole, so that the connector and the base are able to be sealed.

In an example, a locking mode of the second sealing ring selects one of the following schemes:

- scheme 1: an outer wall of the sewage hole is provided with a plurality of first protruding parts; a locking ring for locking the second sealing ring has a plurality of openings at a first side close to the second part of the connector, and a part of each opening is blocked, thereby forming an enter-opening and a limit-opening; an inner diameter of the locking ring at a second side far from the second part of the connector, is smaller than an inner diameter of the second sealing ring; and the first protruding part is configured to be able to enter the enter-opening of the locking ring and then enter the limit-opening of the locking ring by rotation, so that the second sealing ring is locked between the first protruding part and the locking ring;
- scheme 2: an outer wall of the sewage hole is provided with external threads; the locking ring for locking the second sealing ring is provided with internal threads at a first side close to the second part of the connector; an inner diameter of the locking ring at a second side far from the second part of the connector, is smaller than an inner diameter of the second sealing ring; and a rotation matching between the external threads of the sewage hole and the internal threads of the locking ring enables the second sealing ring to be locked between the sewage hole and the locking ring.

In an example, the first part of the connector adjacent to an edge of the connector is provided with a bracket extending toward the seat bowl, and a water inlet pipe hole is formed in the bracket for the arrangement of a water inlet pipe; the water inlet pipe is provided with a sheet-type structure; a mounting groove is formed in the bracket; and the water inlet pipe is fixed by inserting the sheet-type structure into the mounting groove.

In an example, the mounting groove includes a first groove close to a side of the seat bowl, limiting parts being protruding and located at two sides of the bracket, and an inserting part close to a side of the base; the sheet-type structure is configured to be able to be inserted into the mounting groove from the inserting part, and is limited by the first groove, the limiting parts and the base.

In an example, an up water pipe hole and a down water pipe hole are provided in the embedding part of the connector, being adjacent to each other and respectively penetrating through the first part and the second part of the connector, so as to allow an up water pipe and a down water pipe to go through respectively; a partition part for supporting is formed between the up water pipe hole and the down water pipe hole; and the partition part extends toward the base to form a pillar, and the pillar is configured to press a water valve in the base, so as to fix the water valve and conduct force.

In an example, a plurality of recessed parts are formed in the first part and the second part of the connector, and mesh-like reinforcing ribs are arranged in at least a part of the recessed parts.

A second aspect of the present application provides a portable toilet, having a seat bowl, a base, and the connector for connecting the seat bowl and the base described in any of the previous examples.

In an example, the portable toilet has a clear water tank capable of storing clear water; the clean water tank has a recessed arc-shaped part adjacent to a tail of the seat bowl, for limiting excessive rotation of the seat bowl.

In an example, a bottom of the clean water tank is provided with a third protruding part, an upper surface of the base is provided with a second groove, and the clean water tank is able to be mounted on the base through the matching of the third protruding part and the second groove.

The connector provided by at least one example of the present application can be manufactured by one-step molding, has rigidity and strength, and also integrates functions of positioning, sealing, connecting, fixing, pipeline fixing and the like.

According to the connector provided by at least one example of the present application, the fins provided in the connector are used to compensate for irregular size errors formed by different materials in the process of processing and molding when the connector is mounted and connected with the upward ceramic seat bowl of the toilet, and after corrected, allow the base and the ceramic seat bowl to be uniformly stressed.

According to the connector provided by at least one example of the present application, a downward pillar is provided at a side of the connector and used for fixing the water valve mounted in the base, and a force of the water valve is conducted through the pillar, so as to ensure that no position of the water valve relatively changes when the force is applied.

According to the connector provided by at least an example of the present application, a circle of matched buckle bodies which are concentric with the sewage hole is provided at the bottom of the connector, and when it is connected to the base downwards, the connector can be mutually matched with an annular rail on the base, so that the seat bowl can rotate on the premise of achieving load bearing and ensuring the stability of a sealing structure.

Figure 1:
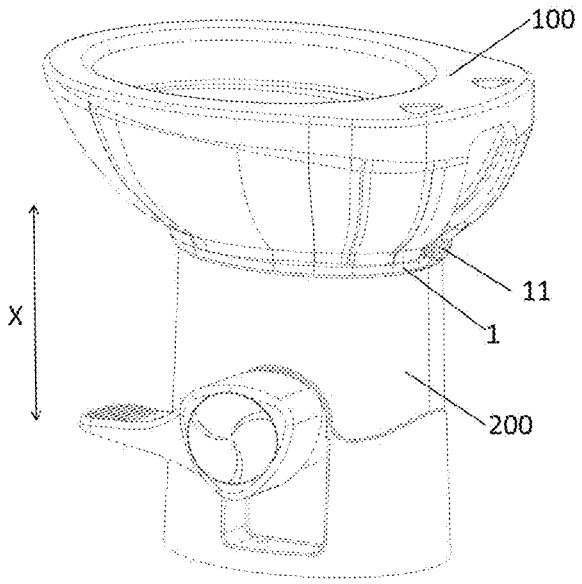
FIG. 1 is a schematic diagram of a combined structure of a seat bowl, a connector and a base according to a first embodiment.

In the drawings: 100 seat bowl, 101 embedding groove; 200 base, 201 buckling groove, 202 water valve, 203 second groove; 300 clean water tank, 301 third protruding part, 302 arc-shaped part; 1 connector, X connecting direction, 2 first part, 3 second part, 4 sewage hole, 41 first groove, 42 step shape, 43 first protruding part, 5 first sealing ring, 6 first mounting hole, 7 second mounting hole, 8 embedding part, 9 fin, 10 water inlet pipe hole, 11 water inlet pipe, 12 bracket, 13 mounting groove, 131 first groove, 132 limiting part, 133 inserting part, 14 sheet-type structure, 15 up water pipe hole, 16 down water pipe hole, 17 partition part, 18 pillar, 19 buckle body, 191 extension part, 192 second protruding part, 193 inclined surface, 194 reinforcing rib, 20 second sealing ring, 21 locking ring, 211 opening, 212 enter-opening, 213 limit-opening, 22 recessed part and 23 reinforcing rib.

DETAILED DESCRIPTION

The technical solutions of the present application will be described in detail below in combination with specific embodiments. However, it should be understood that elements, structures and features in one embodiment may also be advantageously incorporated into other embodiments without further description.

In the description of the present application, it should be noted that terms such as "first" and "second" are used for descriptive purposes only, and cannot be understood as indicating or implying the relative importance, or implicitly indicating the number of indicated technical features. Therefore, the features defined with "first" and "second" may explicitly or implicitly include one or more of these features.

In the description of the present application, it should be noted that the terms "up", "down", "inside", "outside" and the like indicate the positional or positional relationship according to the positional relationship shown in FIG. 1 merely for the convenience of describing the present application and the simplified description, but do not indicate or imply a devices or an element referred to must be of a particular orientation, constructed and operated in a particular orientation and therefore should not be construed as limiting the present application.

In the description of the present application, it should be noted that the terms "connect", "connecting" and "connected" should be understood in a broad sense unless otherwise clearly specified and limited. For example, they might be fixed connection, detachable connection, or integrated connection; might be direct connection or indirect connection through an intermediate medium, and might be internal connection of two elements. For those of ordinary skill in the art, the specific meanings of the above-mentioned terms in the present application can be understood under specific circumstances.

As shown in FIGS. 1-6, a first embodiment of the present application provides a connector 1 for connecting a seat bowl 100 and a base 200 (hereinafter referred to as connector 1 for short), including: a first part 2 facing the seat bowl 100 and a second part 3 facing the base 200 in a connected state, where the first part 2 and the second part 3 are arranged roughly oppositely, for example, the first part 2 is located at an upper part of the connector and the second part 3 is located at a lower part of the connector.

Figure 3:
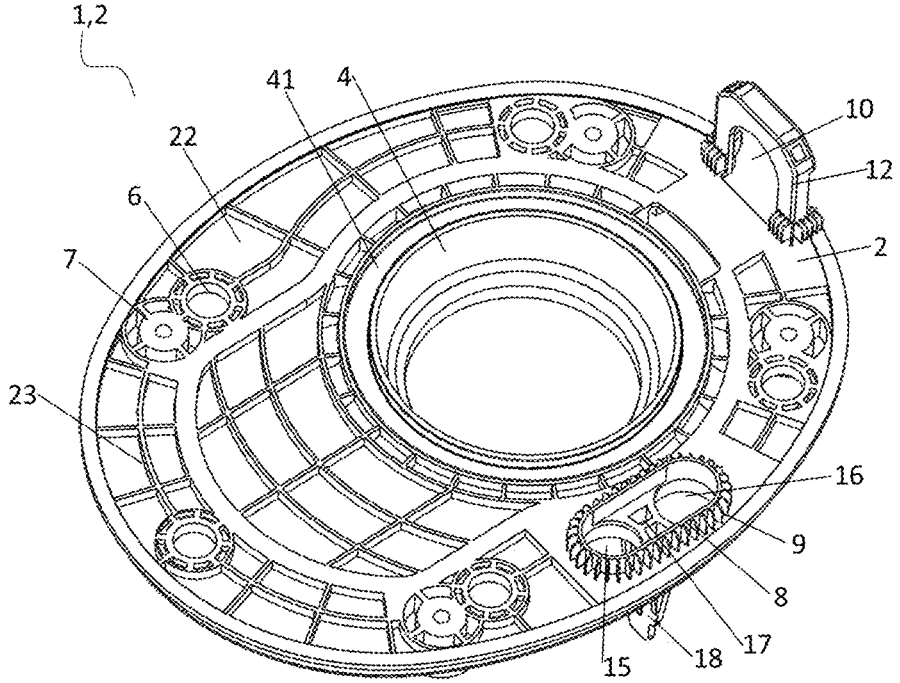
FIG. 3 is a top perspective view of the connector of the first embodiment.
Figure 4:
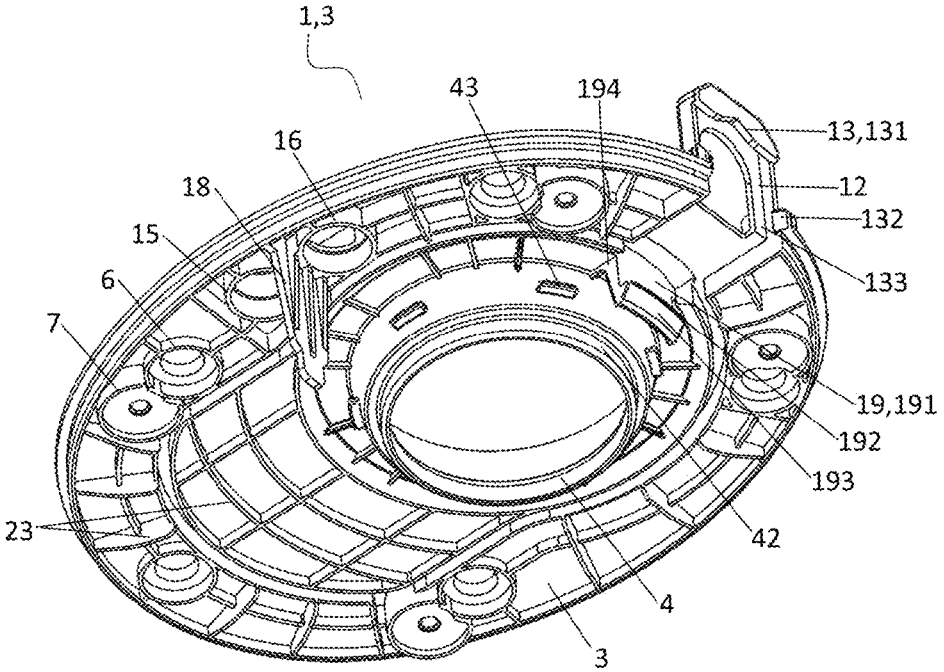
FIG. 4 is a bottom perspective view of the connector of the first embodiment.

As shown in FIG. 3 and FIG. 4, a sewage hole 4 penetrating through the first part 2 and the second part 3 of the connector 1 is formed in a middle part of the connector 1, so that sewage in the seat bowl 100 can be discharged downward through the hole. The base 200 is also internally provided with a sewage passage, and sewage can be connected to the outside through a sewage pipe (not shown). The base 200 in the present application can be made by a blow molding process, and mainly has a supporting function, supporting the seat bowl 100 and other components and supporting a user who uses the toilet.

Figure 2:
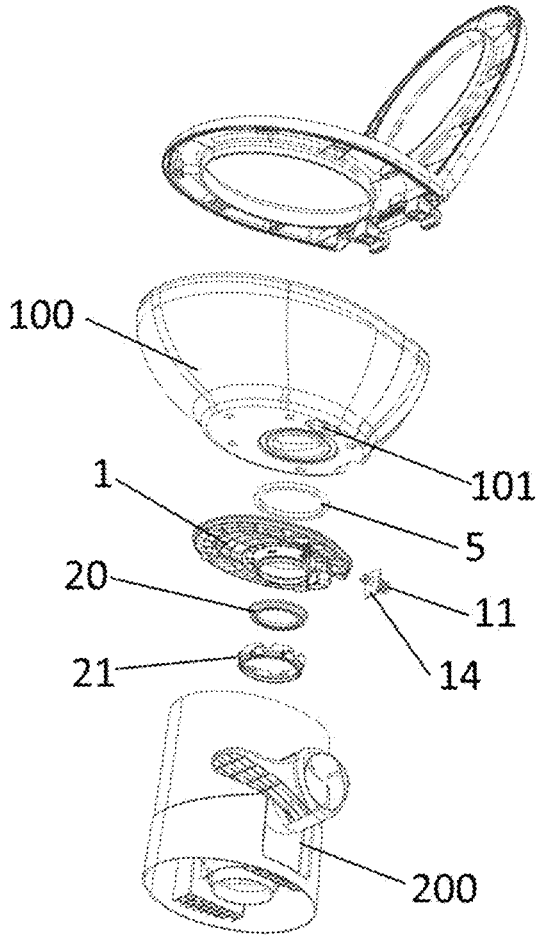
FIG. 2 is an exploded schematic diagram of the seat bowl, the connector and the base of the first embodiment.

As shown in FIG. 2 and FIG. 3, a side of the connector 1 where the sewage hole 4 facing the seat bowl 100 is provided with a first groove 41 capable of accommodating a first sealing ring 5, so as to achieve the sealing between the connector 1 and the seat bowl 100.

The connector 1 is provided with a plurality of first mounting holes 6 and second mounting holes 7 around the sewage hole 4, which respectively penetrate through the first part 2 and the second part 3 of the connector 1. The first mounting holes 6 are configured to mount the connector 1 onto the seat bowl 100; for example, bolts can be inserted from the second part side to the first part side to fix the connector 1 to the seat bowl 100, and the first sealing ring 5 therebetween is also pressed. The second mounting holes 7 are configured to mount the connector 1 onto the base 200; for example, nuts may be pre-embedded at the first part side, and after the seat bowl 100 and the connector 1 are mounted, bolts may be inserted upward from the lower part of the base 200 to cooperate with the pre-embedded nuts to fix the base 200 with the connector 1.

As shown in FIGS. 2-4, the seat bowl 100 is made of ceramic material, and a recessed embedding groove 101 is formed in a bottom of the seat bowl. The whole connector 1 may be made of plastic material, which is manufactured by one-step molding and has certain rigidity and strength. The first part 2 of the connector is provided with a protruding embedding part 8 which is matched with the embedding groove 101; and by inserting the embedding part 8 into the embedding groove 101, the seat bowl 100 and the connector 1 can be matched and aligned.

Further, in order to solve the problem that opening precision of the ceramic seat bowl 100 is low and it is difficult to match, the embedding part 8 is surrounded by a plurality of fins which are distributed at intervals and able to be squeezed to deform, for example, elastic plastic sheets are adopted. These fins 9 may be configured to be evenly spaced along an outer wall of the embedding part 8; and an extending direction of each fin 9 is parallel to a connecting direction X between the seat bowl 100 and the connector 1, and extends vertically in FIG. 3, for example. A bottom of each fin 9 is fixed to the first part 2. A chamfer is formed at one end of each fin 9 toward/near the seat bowl 100, so as to guide the embedding part 8 and the fins 9 to be inserted into the embedding groove 101. When the seat bowl 100 is connected with the connector 1, the embedding part 8 and its fins 9 are in interference fit in the embedding groove 101 at the bottom of the seat bowl 100; in this process, at least part of the fins 9 will be squeezed, deformed, and possibly partially damaged, so as to completely fill in the embedding groove 101; because there may be machining accuracy errors in ceramic openings, the fins 9 will compensate for the operation errors to fix the ceramic seat bowl and bear a force in a horizontal direction, thus preventing the seat bowl from moving in the horizontal direction, and achieving high stability.

As shown in FIGS. 2-4, the connector 1 is provided with a water inlet pipe hole 10 through which a water inlet pipe 11 passes to introduce water from the outside. In a specific embodiment, a bracket 12 extending along the connecting direction X toward the seat bowl 100 is disposed at the first part 2 of the connector, adjacent to an edge of the connector; and the water inlet pipe hole 10 penetrates through the bracket 12. As shown in FIG. 2 and FIG. 4, a mounting groove 13 is also formed in the bracket 12, and the water inlet pipe 11 is provided with a sheet-type structure 14. By inserting the sheet-type structure 14 into the mounting groove 13, the water inlet pipe 11 is fixed to the bracket 12. Further, the mounting groove 13 includes a first groove 131 close to a side of the seat bowl, protruding limiting parts 132 located on two sides of the bracket 12, and an inserting part 133 close to a side of the base; the sheet-type structure 14 can be inserted into the mounting groove 13 from lower to upper from the inserting part 133, so that the top and the two sides of the sheet-type structure 14 are limited by the first groove 131 and the limiting part 132 respectively, and the inserting part 133 at the bottom is limited by the base after being combined with the base 200, thus fixing the water inlet pipe 11.

As shown in FIG. 3, a root part of the bracket 12 adjacent to the first part 2 of the connector can also be provided with a plurality of fins, which are respectively connected with the bracket 12 and the first part 2 of the connector, so that on the one hand, the stability of the bracket 12 can be enhanced, and on the other hand, the fins can be abutted against an opening at a tail of the seat bowl, thus exerting a function of interference fit similar to the fins of the embedding part.

The connector 1 is also provided with an up water pipe hole 15 and a down water pipe hole 16 which are adjacent to each other and penetrate through the first part 2 and the second part 3 of the connector respectively, so as to penetrate through an up water pipe and a down water pipe respectively (not shown). As shown in FIG. 3 and FIG. 4, the up water pipe hole 15 and the down water pipe hole 16 can both be located in a space surrounded by the embedding part 8, so that the embedding part 8 is oval, in which a hollow structure is formed. A partition part 17 is formed between the up water pipe hole 15 and the down water pipe hole 16, and the partition part 17 can support the corresponding up water pipe and down water pipe.

Figure 5:
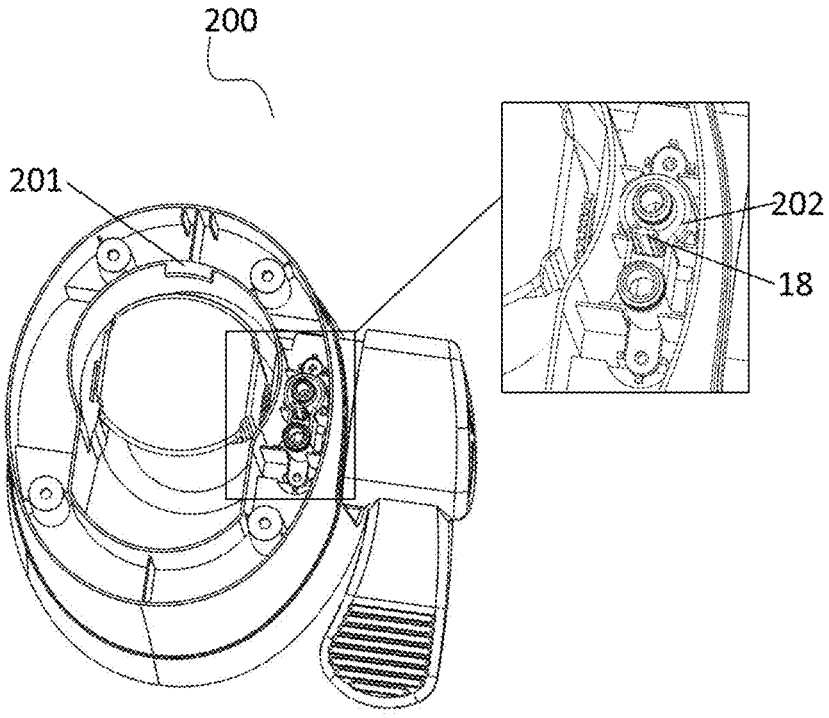
FIG. 5 is a top perspective view of the base of the first embodiment.

The seat bowl 100 has a hollow structure in which water can be stored. As shown in FIG. 5, the base 200 has a pedal-controlled water valve 202, and the water valve 202 is opened or closed by stepping with a foot outside. The water valve 202 is respectively connected with a water feed pipe and a water discharge pipe, wherein the water feed pipe is connected with the hollow structure of the seat bowl 100, and the water discharge pipe is connected with a water nozzle of the seat bowl; these technical solutions are known in the prior art, such as disclosed in CN103147499A. In the present embodiment, water from the outside can enter the hollow structure of the seat bowl 100 upward for storage after entering from the water inlet pipe 11; when the water valve 202 is opened, since the down water pipe (equivalent to the water feed pipe) is connected with the hollow structure of the seat bowl 100, the stored water can be guided to the water valve 202 of the base 200, and the opened water valve 202 guides the water to the up water pipe (equivalent to the water discharge pipe), and then the seat bowl is washed through the water nozzle of the seat bowl 100. The "up" and "down" here refer to the description of the flow direction of water with reference to FIG. 1 and FIG. 2.

As shown in FIG. 4, a pillar 18 is formed on the second part 3 of the connector extending along the connecting direction X toward the base 200. The pillar 18 can extend with the partition part 17 as the root so that the pillar 18 is located between the up water pipe hole 15 and the down water pipe hole 16. Reinforcing ribs extending to the second part 3 may be formed on two sides of the pillar 18 to increase its strength. The pillar 18 is configured to press the water valve 202 in the base 200, as shown in FIG. 5. Since the water valve will be stressed during the start-up, the water valve 202 can be fixed and the stress can be transmitted through the pillar 18.

As shown in FIG. 4 and FIG. 5, the second part 3 of the connector is provided with a buckle body 19 which can be clamped into a buckling groove 201 of the base 200. The buckle body 19 has an extension part 191 which can be squeezed and deformed, which is made of plastic, for example, and which has elasticity. A second protruding part 192 is provided at a free end of the extension part 191, so as to be clamped into the buckling groove 201; and one side of the second protruding part 192 toward the base 200 is an inclined surface 193 to guide the clamping. In addition, reinforcing ribs 194 may be provided between the extension part 191 and the second part 3 to enhance the strength of the buckle body 19. Through the connection between the buckle body 19 and the buckling groove 201, the gravity caused by a downward sitting pressure of the user in an opposite direction during use can be resisted.

As shown in FIG. 2 and FIG. 4, the sewage hole 4 extends along the connecting direction X toward the base 200, and an annular step shape 42 is formed at its free end, which can accommodate a second sealing ring 20 with an L-shaped cross section and adapted (matched) to an outer wall of the step shape 42, so as to achieve the sealing between the connector 1 and the base 200.

Figure 6:
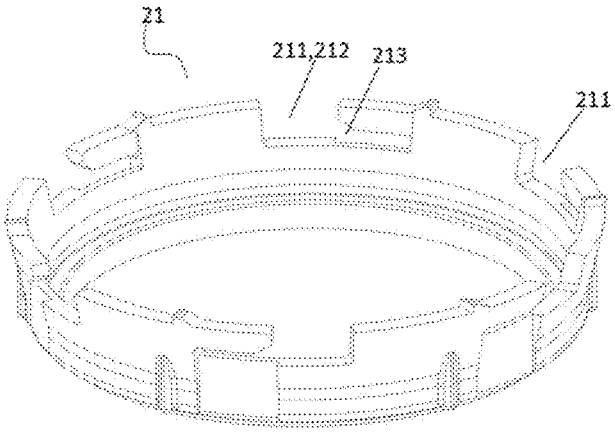
FIG. 6 is a structural schematic diagram of a locking ring of the first embodiment.

Further, in order to better fix the second sealing ring 20 and prevent it from falling off, as shown in FIG. 4 and FIG. 6, a plurality of first protruding parts 43 are arranged at an outer wall of the sewage hole 4 in a circumferential direction. A locking ring 21 for locking the sealing ring 20 has a plurality of openings 211 at a side close to the second part 3 of the connector 1; and a part of each opening 211 is blocked, thereby forming an enter-opening 212 and a limit-opening 213 which are interconnected with each other; an inner diameter of the locking ring 21 at a side far from the second part 3 of the connector 1 is smaller than an outer diameter of the second sealing ring 20. The first protruding part 43 is configured to be able to enter the enter-opening 212 of the locking ring 21, and then enter the limit-opening 213 of the locking ring 21 by rotation, so that the second sealing ring 20 is locked between the first protruding part 43 and the locking ring 21 and is not easy to fall off.

In the present embodiment, the sealing between the connector 1 and the base 200 mainly depends on the second sealing ring 20, and the stable connection therebetween mainly depends on the buckle body 19.

As shown in FIG. 3 and FIG. 4, the first part 2 and the second part 3 of the connector may also be formed with a plurality of recessed parts 22, and mesh-like reinforcing ribs 23 are arranged in at least a part of these recessed parts, so that the supporting strength of the connector 1 can be increased while the weight of the connector is reduced.

The second embodiment of the present application provides a portable toilet, as shown in FIG. 1 and FIG. 2, which includes the connector 1 for connecting the seat bowl and the base as described in the first embodiment.

As shown in FIGS. 7-11, a third embodiment of the present application provides another connector 1 for connecting a seat bowl 100 and a base 200. The connector includes: a first part 2 facing the seat bowl 100 and a second part 3 facing the base 200 in a connected state, where the first part 2 and the second part 3 are arranged roughly oppositely.

Figure 9:
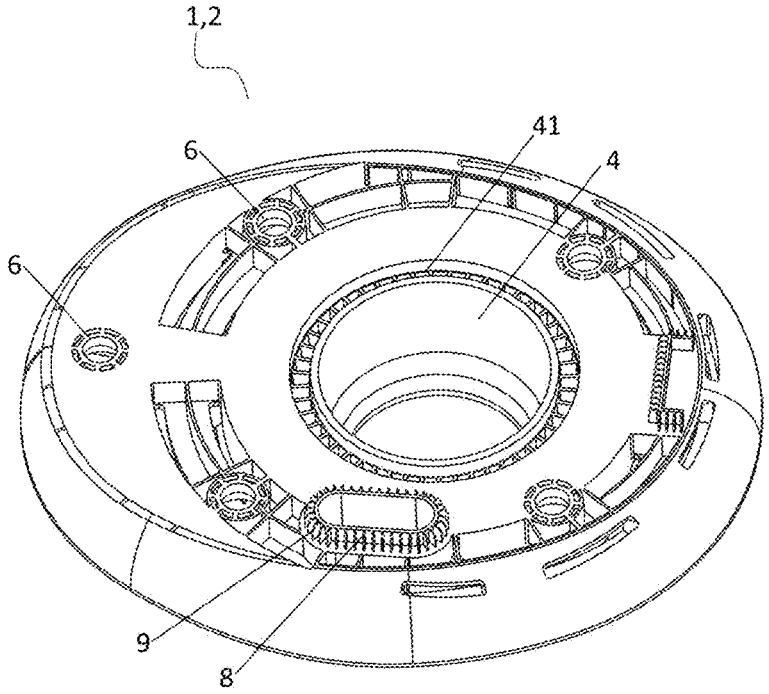
FIG. 9 is a top perspective view of the connector of the second embodiment.
Figure 10:
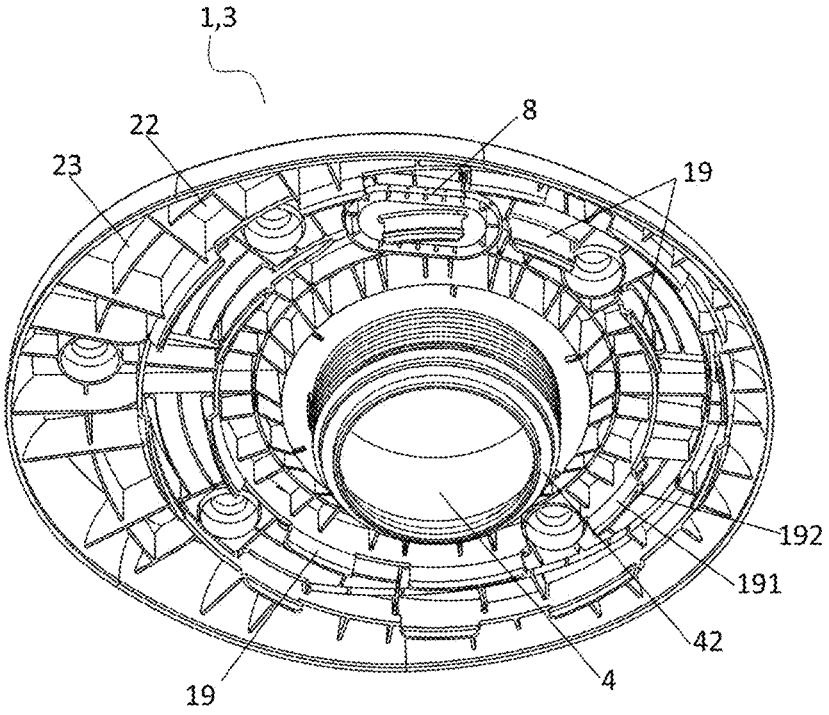
FIG. 10 is a bottom perspective view of the connector of the second embodiment.

As shown in FIG. 9 and FIG. 10, a sewage hole 4 penetrating through the first part 2 and the second part 3 of the connector 1 is formed in a middle part of the connector 1, so that sewage in the seat bowl 100 can be discharged downward through the hole. The base 200 mainly has a supporting function, in which a movable sewage tank (not shown) that can be drawn out from one side can be provided to contain sewage.

Figure 8:
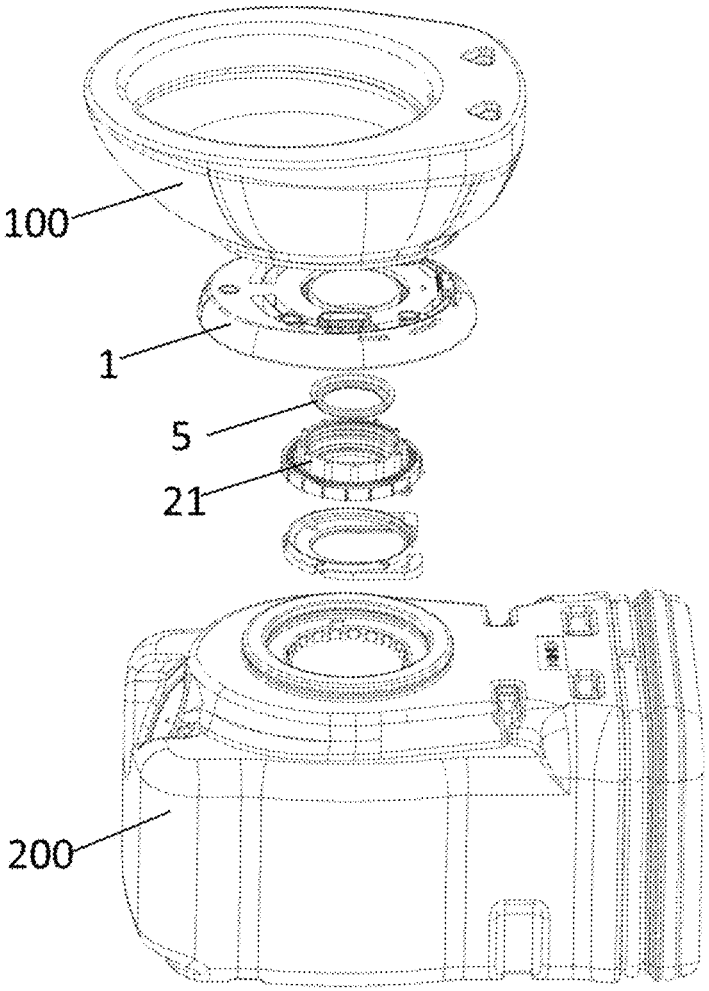
FIG. 8 is an exploded schematic diagram of the seat bowl, the connector and the base of the second embodiment.

As shown in FIG. 8 and FIG. 9, the connector 1 at a side where the sewage hole 4 facing the seat bowl 100 is provided with a first groove 41 capable of accommodating a first sealing ring 5, so as to achieve the sealing between the connector 1 and the seat bowl 100.

The connector 1 is provided with a plurality of first mounting holes 6 around the sewage hole 4, which respectively penetrate through the first part 2 and the second part 3 of the connector 1. The first mounting holes 6 are configured to mount the connector 1 onto the seat bowl 100; for example, bolts can be inserted upward from the lower part to fix the connector 1 to the seat bowl 100, and the first sealing ring 5 therebetween is also pressed.

The seat bowl 100 is made of ceramic material, and a recessed embedding groove 101 is formed in a bottom of the seat bowl. The connector 1 can be made of plastic material.

The first part 2 of the connector is provided with a protruding embedding part 8 which is matched with the embedding groove 101; and by inserting the embedding part 8 into the embedding groove 101, the seat bowl 100 and the connector 1 can be matched and aligned.

Further, in order to solve the problem that opening precision of the ceramic seat bowl 100 is low and it is difficult to match, the embedding part 8 is surrounded by a plurality of fins 9 which are distributed at intervals and able to be squeezed to deform, for example, elastic plastic sheets are adopted. These fins 9 may be configured to be evenly spaced along an outer wall of the embedding part 8; and an extending direction of each fin 9 is parallel to the connecting direction X of the seat bowl 100 and the connector 1. A bottom of each fin 9 is fixed to the first part 2. A chamfer is formed at one end of each fin 9 toward/near the seat bowl 100, so as to guide the embedding part 8 and the fin 9 to be inserted into the embedding groove 101. When the seat bowl 100 is connected with the connector 1, the embedding part 8 and its fins 9 are in interference fit in the embedding groove 101 at the bottom of the seat bowl 100; in this process, at least part of the fins 9 will be squeezed, deformed, and possibly partially damaged, so as to be completely fill in the embedding groove 101; with the effect the same as that of the first embodiment.

The seat bowl 100 is provided with a water nozzle; the base 200 can store sewage; this technical solution is known in the prior art, such as disclosed in CN103147499A. In the present embodiment, water from the outside is directly connected to the water nozzle of the seat bowl 100 to wash the seat bowl 100, and then flows into the sewage tank in the base 200 through the sewage hole 4, so that no up water pipe nor down water pipe are provided as that in the first embodiment.

As shown in FIG. 10, the second part 3 of the connector is provided with a plurality of buckle bodies 19 around the sewage hole 4, which are arranged evenly and at intervals; and each of the buckle bodies 19 is located on a circumference of a same circle and is able to be clamped into an annular buckling groove (not shown) of the base 200, so as to be in a rotatable state. Each buckle body 19 has an extension part 191 which can be squeezed and deformed, which is made of plastic, for example, and which has elasticity. A second protruding part 192 is provided at a free end of the extension part 191, so as to be clamped into the buckling groove; and one side of the second protruding part 192 toward the base 200 is an inclined surface 193 to guide the clamping. Through the connection between the buckle bodies 19 and the buckling groove, a rotatable rail structure is formed, so that the connector 1 can rotate after being combined upwards with the ceramic seat bowl 100; in addition, the gravity caused by a downward sitting pressure of the user in an opposite direction during use can be resisted.

As shown in FIG. 10, the sewage hole 4 extends along the connecting direction X toward the base 200, and an annular step shape 42 is formed at its free end, which can accommodate a second sealing ring 20 with an L-shaped cross section and adapted (matched) to an outer wall of the step shape 42, so as to achieve the sealing between the connector 1 and the base 200.

Figure 11:
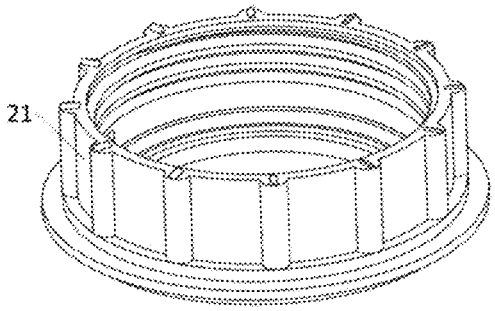
FIG. 11 is a structural schematic diagram of a locking ring of the second embodiment.

In order to better fix the second sealing ring 20 and prevent it from falling off, as shown in FIG. 10 and FIG. 11, an outer wall of the sewage hole 4 may be provided with external threads; a locking ring 21 for locking the sealing ring 20 is provided with internal threads at a side close to the connector 1, and an inner diameter of the locking ring 21 at a side far from the connector 1 is slightly smaller than an outer diameter of the second sealing ring 20; and the rotation matching between the external threads of the sewage hole 4 and the internal threads of the locking ring 21 enables the second sealing ring 20 to be locked between the sewage hole 4 and the locking ring 21, and is not easy to fall off.

In the present embodiment, the sealing between the connector 1 and the base 200 mainly depends on the second sealing ring 20, and the stable connection therebetween mainly depends on the buckle bodies 19.

The first part 2 and the second part 3 of the connector may be formed with a plurality of recessed parts 22 to reduce the weight of the connector 1.

It can be seen that compared with the first embodiment, the third embodiment omits the up water pipe hole 15 and the down water pipe hole 16; it is not necessary to have the up water pipe hole and the down water pipe hole because the water is directly fed; and structures such as the second mounting holes 7 are also omitted. In addition, in the third embodiment, the connector 1 can rotate relative to the base 200, which improves the flexibility of the use scenario. It can be understood that some technical solutions of the two embodiments can be mutually referenced based on actual situations, such as the arrangement of the locking ring, the arrangement of the mesh-like reinforcing ribs, etc.

A fourth embodiment of the present application provides a portable toilet, as shown in FIG. 7, FIG. 8, FIG. 12 and FIG. 13, which includes the connector 1 for connecting the seat bowl and the base as described in the previous third embodiment.

Further, a clean water tank 300 for storing clean water is provided on the base 200, which is connected with the seat bowl 100 and able to directly provide clean water for the seat bowl 100.

Figure 7:
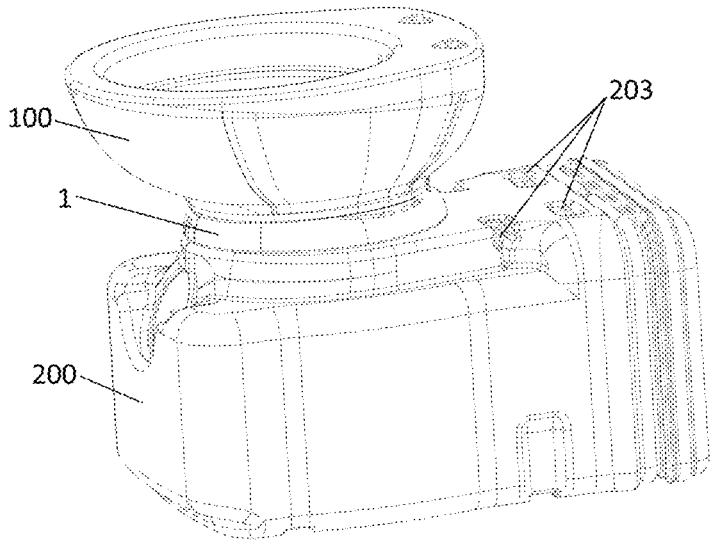
FIG. 7 is a schematic diagram of a combined structure of a seat bowl, a connector and a base according to a second embodiment.
Figure 13:
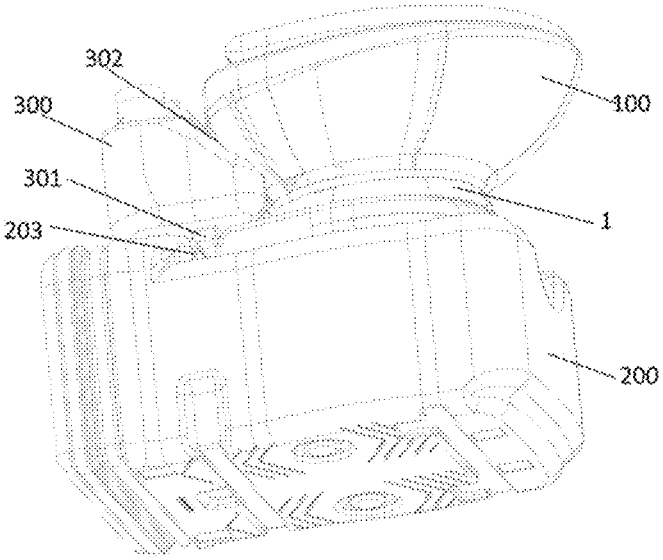
FIG. 13 is a bottom perspective view of the portable toilet of the embodiment.

An upper surface of the base 200 has one or more recessed second grooves 203 (as shown in FIG. 7 and FIG. 13); the clean water tank 300 has a third protruding part or third protruding parts 301 extending toward the base 200; and the third protruding part 301 can be embedded into the second groove 203 of the base 200 to fix the clean water tank 300 onto the base 200.

Figure 12:
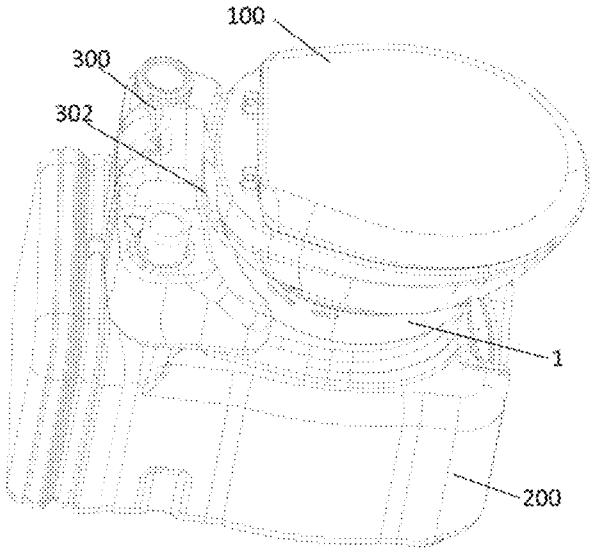
FIG. 12 is a top perspective view of a portable toilet according to an embodiment.

In some embodiments, as shown in FIG. 12 and FIG. 13, the clean water tank 300 also has a recessed arc-shaped part 302; and the arc-shaped part 302 is adjacent to a tail of the seat bowl 100, which limits excessive rotation of the seat bowl 100. When in use, the seat bowl can rotate about 90 degrees to the left and right respectively, but not 360 degrees completely.

In addition, the clean water tank 300 may also be provided with components such as water adding port and water flush button, which are well known to those skilled in the art.

Finally, it should be noted that the various embodiments in the present description are described in a progressive way, and each embodiment focuses on the differences from other embodiments, so it is necessary to refer to the same and similar parts between the embodiments.

The embodiments are only described as preferred embodiments of the present application, and are not intended to limit the scope of the present application. Various modifications and improvements made on the technical solutions of the present application by ordinary skill in the art without departing from the design spirit of the present application shall fall within the protective scope confirmed by the claims of the present application.

The invention claimed is:

1. A connector for connecting a seat bowl and a base, the connector including:

a first part, facing to and being connected with the seat bowl in a connected state;

a second part, facing to and being connected with the base in the connected state;

a sewage hole, formed in a middle part of the connector and penetrating through the first part and the second part; and an embedding part, protrudingly formed on the first part and capable of being matched with an embedding groove at a bottom of the seat bowl;

wherein, an outer wall of the embedding part is provided with a plurality of fins at intervals, able to be squeezed to deform; and the connector is configured as: when the seat bowl is connected with the connector, the embedding part and the fins are in interference fit in the embedding groove of the seat bowl;

wherein, the fins are elastic plastic sheets; and an extending direction of each fin is parallel to a connecting direction of the seat bowl and the connector;

wherein, the fins are evenly distributed on the outer wall of the embedding part; a bottom of each fin is connected with the first part of the connector; and a chamfer is formed at one end of each fin toward the seat bowl, so as to guide the embedding part and the fins to be inserted into the embedding groove.

2. The connector according to claim 1, wherein, the seat bowl is made of ceramic material; and the connector is a flat structure made of plastic material.

3. The connector according to claim 1, wherein, the connector is provided with a plurality of first mounting holes and second mounting holes around the sewage hole, respectively penetrating through the first part and the second part of the connector; the first mounting holes are configured to mount the connector onto the seat bowl; and the second mounting holes are configured to mount the connector onto the base.

4. The connector according to claim 1, wherein, the second part of the connector is provided with a buckle body, able to be clamped into a buckling groove of the base to connect the connector and the base.

5. The connector according to claim 4, wherein, the buckle body has an extension part able to be squeezed and deformed; a protruding part is provided at a free end of the extension part, so as to be clamped into the buckling groove of the base; and one side of the protruding part toward the base is an inclined surface to guide the clamping.

6. The connector according to claim 5, wherein, the second part of the connector is provided with a plurality of buckle bodies at intervals around the sewage hole; the buckle bodies are located on a circumference of a same circle, and are able be clamped into an annular buckling groove of the base, so as to be in a rotatable state.

7. The connector according to claim 4, wherein, the second part of the connector is provided with a plurality of buckle bodies at intervals around the sewage hole; the buckle bodies are located on a circumference of a same circle, and are able be clamped into an annular buckling groove of the base, so as to be in a rotatable state.

8. The connector according to claim 1, wherein, the sewage hole is provided with a first groove at the first part to accommodate a first sealing ring, so that the seat bowl and the connector are able to be sealed; and the sewage hole extends from the second part toward the base and an annular step shape is formed at a free end of the sewage hole, and a second sealing ring is matched with the step shape of the sewage hole, so that the connector and the base are able to be sealed.

9. The connector according to claim 8, wherein, a locking mode of the second sealing ring selects from one of the following schemes:

scheme 1: an outer wall of the sewage hole is provided with a plurality of protruding parts; a locking ring for locking the second sealing ring has a plurality of openings at a first side close to the second part of the connector, and a part of each opening is blocked, thereby forming an enter-opening and a limit-opening interconnected with each other; an inner diameter of the locking ring at a second side far from the second part of the connector, is smaller than an outer diameter of the second sealing ring; and each of the protruding parts is configured to be able to enter the enter-opening of the locking ring, and then enter the limit-opening of the locking ring by rotation, so that the second sealing ring is locked between the protruding parts and the locking ring;

scheme 2: an outer wall of the sewage hole is provided with external threads; the locking ring for locking the second sealing ring is provided with internal threads at a first side close to the second part of the connector; an inner diameter of the locking ring at a second side far from the second part of the connector, is smaller than an outer diameter of the second sealing ring; and a rotation matching between the external threads of the sewage hole and the internal threads of the locking ring enables the second sealing ring to be locked between the sewage hole and the locking ring.

10. The connector according to claim 1, wherein, the first part of the connector adjacent to an edge of the connector is provided with a bracket extending toward the seat bowl, and a water inlet pipe hole is formed in the bracket for the arrangement of a water inlet pipe; the water inlet pipe is provided with a sheet-type structure; a mounting groove is formed in the bracket; and the water inlet pipe is fixed by inserting the sheet-type structure into the mounting groove.

11. The connector according to claim 10, wherein, the mounting groove includes a first groove close to a side of the seat bowl, limiting parts being protruding and located at two sides of the bracket, and an inserting part close to a side of the base; the sheet-type structure is configured to be able to be inserted into the mounting groove from the inserting part, and is limited by the first groove, the limiting parts and the base.

12. The connector according to claim 11, wherein, an up water pipe hole and a down water pipe hole are provided in the embedding part of the connector, being adjacent to each other and respectively penetrating through the first part and the second part of the connector, so as to allow an up water pipe and a down water pipe to go through respectively; a partition part for supporting is formed between the up water pipe hole and the down water pipe hole; and the partition part extends toward the base to form a pillar, and the pillar is configured to press a water valve in the base, so as to fix the water valve and conduct force.

13. The connector according to claim 1, wherein, a plurality of recessed parts are formed in the first part and the second part of the connector, and mesh-like reinforcing ribs are arranged in at least a part of the recessed parts.

14. A portable toilet having a seat bowl, a base, and the connector for connecting the seat bowl and the base according to claim 1.

15. The portable toilet according to claim 14, wherein, the portable toilet has a clean water tank capable of storing clean water; the clean water tank has a recessed arc-shaped part adjacent to a tail of the seat bowl, for limiting excessive rotation of the seat bowl.

16. The portable toilet according to claim 15, wherein, a bottom of the clean water tank is provided with a protruding part, an upper surface of the base is provided with a groove, and the clean water tank is able to be mounted on the base through the matching of the protruding part and the groove.

17. A connector for connecting a seat bowl and a base, the connector including:

a first part, facing to and being connected with the seat bowl in a connected state;

a second part, facing to and being connected with the base in the connected state;

a sewage hole, formed in a middle part of the connector and penetrating through the first part and the second part; and an embedding part, protrudingly formed on the first part and capable of being matched with an embedding groove at a bottom of the seat bowl;

wherein, an outer wall of the embedding part is provided with a plurality of fins at intervals, able to be squeezed to deform; and the connector is configured as: when the seat bowl is connected with the connector, the embedding part and the fins are in interference fit in the embedding groove of the seat bowl;

wherein, the fins are elastic plastic sheets; and an extending direction of each fin is parallel to a connecting direction of the seat bowl and the connector;

wherein, the connector is provided with a plurality of first mounting holes and second mounting holes around the sewage hole, respectively penetrating through the first part and the second part of the connector; the first mounting holes are configured to mount the connector onto the seat bowl; and the second mounting holes are configured to mount the connector onto the base.

18. A portable toilet having a seat bowl, a base, and a connector for connecting the seat bowl and the base;

the connector including:

a first part, facing to and being connected with the seat bowl in a connected state;

a second part, facing to and being connected with the base in the connected state;

a sewage hole, formed in a middle part of the connector and penetrating through the first part and the second part; and an embedding part, protrudingly formed on the first part and capable of being matched with an embedding groove at a bottom of the seat bowl;

wherein an outer wall of the embedding part is provided with a plurality of fins at intervals, able to be squeezed to deform; and the connector is configured as: when the seat bowl is connected with the connector, the embedding part and the fins are in interference fit in the embedding groove of the seat bowl;

wherein the portable toilet has a clean water tank capable of storing clean water; the clean water tank has a recessed arc-shaped part adjacent to a tail of the seat bowl, for limiting excessive rotation of the seat bowl.

* * * * *